US005599566A

United States Patent [19]

Casolari

[11] Patent Number: 5,599,566

[45] Date of Patent: Feb. 4, 1997

[54] FLOATING PLANE FOR PRESS PUNCHES

[76] Inventor: Fabio Casolari, Via G. Fontana 12/A, 42014 Castellarano (Prov. of Reggio Emilia), Italy

[21] Appl. No.: 506,446

[22] Filed: Jul. 24, 1995

[30] Foreign Application Priority Data

Jul. 27, 1994 [IT] Italy ..... RE94A0063

[51] Int. Cl.[6] ..... B30B 15/06

[52] U.S. Cl. ..... 425/405.1; 100/295; 425/406

[58] Field of Search ..... 425/405.1, 406, 425/DIG. 44; 100/258 A, 258 R, 295

[56] References Cited

U.S. PATENT DOCUMENTS

| | | | |
|---|---|---|---|
| 2,005,260 | 6/1935 | Huyett . | |
| 3,742,537 | 7/1973 | Merrill | 425/405.1 |
| 3,833,333 | 9/1974 | Britten | 425/406 |
| 3,969,051 | 7/1976 | Hovila | 425/405.1 |
| 4,243,368 | 1/1981 | Garabedian | 425/405.1 |
| 4,395,211 | 7/1983 | Broeksema et al. | 425/405.1 |
| 4,576,092 | 3/1986 | Yamato | 100/218 |
| 4,753,160 | 6/1988 | Baird et al. | 425/406 |
| 5,330,346 | 7/1994 | Scardovi | 425/405.1 |

FOREIGN PATENT DOCUMENTS

| | | | |
|---|---|---|---|
| 686942 | 9/1930 | France . | |
| 1007047 | 4/1957 | Germany . | |
| 63-39322 | 2/1988 | Japan | 425/405.1 |
| 442730 | 1/1968 | Switzerland . | |

*Primary Examiner*—James P. Mackey
*Attorney, Agent, or Firm*—Guido Modiano; Albert Josif

[57] ABSTRACT

A punch is oscillatably supported by a layer of elastic material which forms one of the walls of an intermediate even partition of a non-compressible fluid such as oil. The opposite wall of this partition includes the plane of an isostatic support to which the punch is fixed by movable, axially sliding equipment.

20 Claims, 1 Drawing Sheet

FLOATING PLANE FOR PRESS PUNCHES

BACKGROUND OF THE INVENTION

The present invention relates to a floating plane for press punches, which substantially comprises an isostatic support or base on which the fixing of a punch is performed by means of an intermediate partition, filled with non-compressible fluid such as oil, including a stiff wall corresponding to the plane of said isostatic base and an opposite wall of elastic material, such as rubber or the like, whereon the punch is coupled.

The stable coupling between said isostatic base and said punch is obtained by vulcanized means or by sliding water-tight through pins or the like.

During the pressing steps, particularly for ceramic tile pressing, the non-compressible oil or fluid contained in the intermediate partition presses on its elastic wall and, consequently, on the punch coupled thereto, with a substantially uniform pressure on the whole surface, regardless of the weight concentration and/or concentration of the clays to be pressed. This allows the punch to be appropriately oriented, compensating any loading unevenness of the clays and/or powders in the moulds, oscillating on its whole surface.

In fact, it is known that clay pressing for the formation of ceramic products, such as for example tiles, causes serious problems.

In particular, the powder loading is quite often uneven with respect to the volume and the density inside the moulds, with consequent uneven pressing on the tile surfaces and irregular shrinkage in the subsequent firing, which involve considerable waste percentages or product declassing.

Recent technological innovations have determined the use of isostatic pressings which comprise punches with fluid circulation; even though these innovations allow to achieve uniform pressing with elimination of size variations, convexities and deformations of the pressed or fired products, they have other drawbacks caused by limitations in the shapes of the tile lower parts, with consequent problems on the outer sides of glazed and fired tiles. Furthermore this kind of equipment is very expensive.

Other more recent and innovative solutions have solved said problem by means of floating planes fixing the punches to the presses which are coupled to plates made of elastic material, in which some floating elements are fixed and are matched with hydraulic pistons sliding in seats provided on intermediate plates.

These intermediate plates are fixed to bases including hydraulic ducts for feeding said pistons.

During the pressing, the non-compressible fluid present in the ducts works on the pistons proportionally to the distribution of thickness and/or density of the powders to be pressed, which are discharged on the moulds.

Although these solutions have achieved excellent results and guarantee very high quality products, they are still quite expensive as far as manufacturing costs.

Another embodiment consists in that on the even surface of a support or base there is a hydraulic duct on metal sheet with a thickness of few tenths (5÷6/10) mm. An elastic layer, for example rubber, with a thickness of few tenths (5÷6/10) mm is applied thereon, for example by vulcanization.

Even this embodiment does not achieve the intended aim as regards the position and the evenness of density of the pressed material.

The aim of the present invention is to eliminate the above-mentioned drawback.

SUMMARY OF THE INVENTION

The invention, as defined in the appended claims, solves the above drawback by means of a floating plane for press punches, whereby the following results can be achieved: every press punch is fixed and supported by a wall made of elastic material, which is comprised in an intermediate partition in which there is a non-compressible operating fluid: the intermediate partition includes the above elastic wall, some elastic peripheral walls and a stiff wall opposite the first one, which may be an integral part and/or correspond to the basis of an isostatic support or base; every punch is connected with the corresponding isostatic base by means of several elastic water-tight and sliding means.

The advantages resulting from the present invention substantially reside in that the elastic supporting configuration of each punch, the intermediate partition containing the non-compressible operating fluid and the connection means between said punch and the corresponding isostatic base have a very simple structure, and can be easily produced at very low costs.

Another advantage resides in that each punch can be appropriately oriented with respect to the loading unevenness of the clays and/or powders to be pressed, oscillating on its whole surface and giving very small differences in thickness—just few tenths of a millimeter—to the finished ceramic products obtained by pressing and firing.

Furthermore, the tiles and/or the ceramic products obtained by pressing and firing have variations in thickness which range in quite reduced tolerance limits as well as a perfect density homogeneity in all their parts.

BRIEF DESCRIPTION OF THE DRAWINGS

The invention is described in detail hereinafter according to an embodiment given only by way of non-limitative example, illustrated in the enclosed drawings, wherein.

DESCRIPTION OF THE PREFERRED EMBODIMENTS

Figure 1:
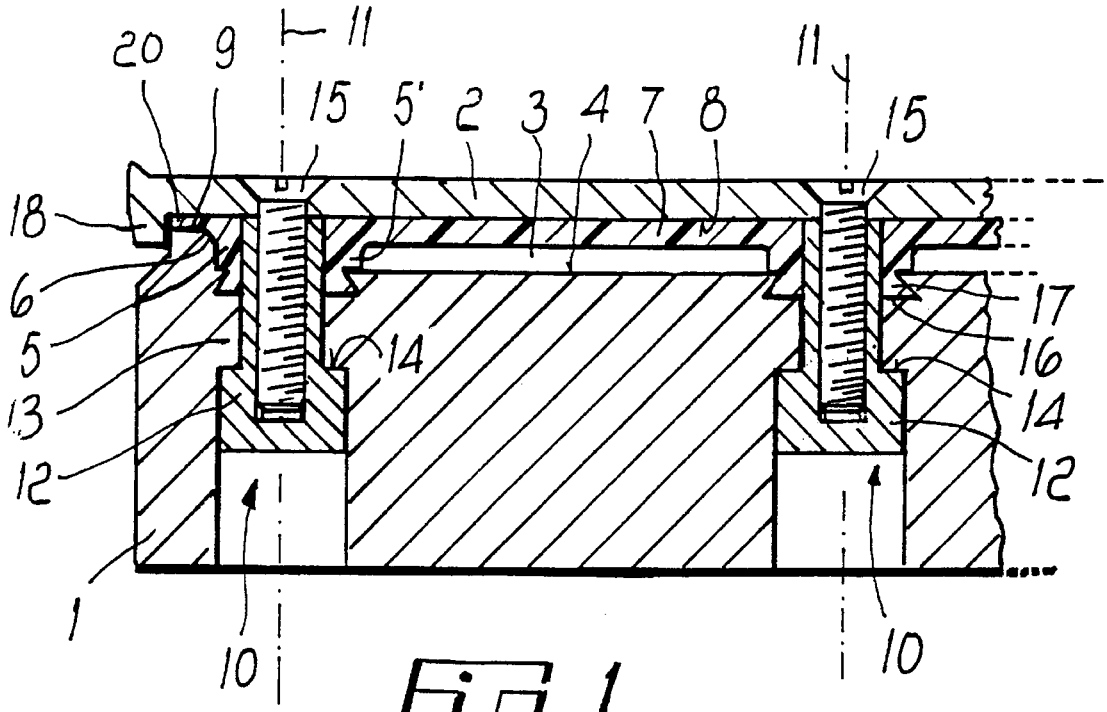
FIG. 1 shows a plan view of a floating punch for tiles.
Figure 2:
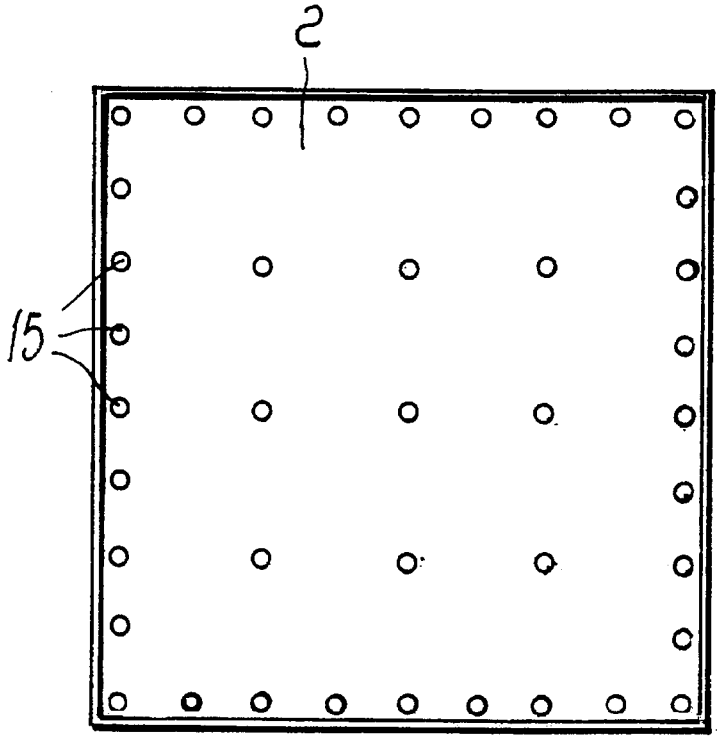
FIG. 2 shows a partial cross section of said punch applied to the corresponding base with intermediate partition with elastic walls.

The figures show a floating plane for press punches substantially comprising an isostatic support or base 1 on which a punch 2 is fixed by means of an intermediate partition 3, filled with non-compressible operating fluid such as oil or another equivalent fluid. The intermediate partition 3 is delimited, on the base side, by a metal wall 4 that may be constituted by the lower part of the same base; along its perimeter, it is delimited by elastic walls 5 that fit the edge 6 of the same base; on the punch side, by an elastic wall 7 which is coupled with the whole bottom 8 of the punch and with the elastic peripheral walls 5 with extension 20 on the external surface 9 of the edge 6 of the isostatic base 1.

The elastic walls 5, 7 and 20 are coupled with the metal walls 4, 6, 8 and 9 by vulcanization or other adapted and conventional adhesion means. The elastic material which constitutes the walls 5, 7 and 20 may be rubber or any other material having a good degree of elastic deformability and resistance to the high working pressures caused by the operating fluid.

The punch 2 and the isostatic base 1 are connected to each other and to the elastic walls of the intermediate partition 3 by several orthogonal means 10, which are slideable in the direction of its longitudinal axis of symmetry 11.

According to a non-limitative example, the means 10 are constituted by pistons 12 that are slideable in sleeves 13 with a rear stop 14 provided in the base 1. In the front part the pistons 12 are linked to the bottom 8 of the punch 2 by means of screws 15 and are embedded into the same elastic material 5' constituting the elastic walls 5 and 7, so as to realize a perfect hydraulic seal with respect to the non-compressible operating fluid present in the intermediate partition 3.

For a better mechanical seal, around any connection means 10 and at the surface 4 of the base 1, some seats 16, with undercut sloping walls in which the elastic material 17 is fixed, are formed.

In the described embodiment the elastic walls 5, 4, 7, 17 and 20 constitute a monolithic element without any discontinuity and/or separation.

During pressing, even with uneven powder loading, the punch 2 can appropriately oscillate or fluctuate on its whole surface and can be oriented as a function of the powder distribution, whereas the non-compressible operating fluid is appropriately distributed in the intermediate partition 3 with respect to the above-mentioned orientation, pressing with an even and balanced action all over the bottom 8 of the punch.

The external peripheral edge 18 of the punch 2 working with the orthogonal means 10 which oscillate in the direction of their axis of symmetry 11, keeps the centering of the oscillating system coupling with the peripheral edge 6 of the base 1.

This telescopic coupling 18—6 guarantees a perfect sliding of the parts and a correct fluctuation of the punch 2 on its whole surface; the functional structure is also characterized in that the operating conditions allow the utilization of punches 2 with small thickness which are consequently less expensive.

The above-mentioned feature derives from the fact that the punches are appropriately and uniformly supported by balanced pressures of the fluid operating on their bottom and by the peripheral slide of the edge 18 on the edge 6 of the bases.

Whereas this invention has been described and illustrated on the basis of an exemplifying embodiment, it will be clear for those skilled in the art that various changes to the details, configurations, positioning and direction of the components and the general structure can be made without modifying its scope.

What is claimed is:

1. A floating plane for press punches, comprising:

a bottom of the floating plane;

an isostatic base;

an intermediate partition for non-compressible operating fluid, said intermediate partition including a wall made of elastic material which couples to and fits the bottom of said floating plane;

linking and sliding orthogonal means for coupling said floating plane to said base such that the intermediate partition is arranged between said floating plane and said base; and elastic peripheral elements of said intermediate partition to which said linking and sliding orthogonal means are coupled so as to provide a fluid-tight seal inside said intermediate partition for the operating fluid.

2. Floating plane according to claim 1, wherein the intermediate partition is delimited: on a base side thereof by a stiff metal wall; along a perimeter thereof by peripheral walls of said elastic wall that fit a peripheral edge of said base; and on a punch side thereof by said elastic wall which couples to a whole bottom of the floating plane.

3. Floating plane according to claim 2, wherein the elastic wall, coupled to the bottom of the floating plane, include peripherally extending extensions coupling to an external surface of the peripheral edge of said base.

4. Floating plane according to claim 3, wherein the peripheral edge of the base is slidingly centered with respect to an external peripheral edge of said floating plane.

5. Floating plane according to claim 1, wherein said linking and sliding orthogonal means include a longitudinal axis of symmetry extending in a direction along which said linking and sliding orthogonal means are adapted to slide.

6. Floating plane according to claim 5, wherein the linking and sliding orthogonal means are constituted by:

sleeves with step-like stop which are provided on the base;

pistons adapted for sliding in said sleeves and being biased for engagement with said stops; and screws for coupling said pistons to said floating plane.

7. Floating plane according to claim 3, wherein on a plane of the base arranged adjacent said intermediate partition, at each linking and sliding orthogonal means, there is provided a portion of said wall of said intermediate partition with undercut sloping walls, said portion of said wall being lodged in a corresponding seat provided in said base.

8. Floating plane according to claim 7, wherein said elastic wall and said peripheral walls and said extensions and said portion with undercut sloping walls all form a monolithic element void of discontinuities and separations, said elastic material being an elastically deformable and pressure-resistant material.

9. Floating plane according to claim 1, wherein the floating plane and the base have mutually facing surfaces of substantially equal dimensions.

10. Floating plane according to claim 9, wherein the floating plane comprises a peripheral edge which is telescopically coupled with a peripheral edge of the base.

11. A floating plane for press punches, comprising:

a bottom of the floating plane;

an isostatic base;

an intermediate partition for non-compressible operating fluid, said intermediate partition including a wall made of elastic material which couples to and fits the bottom of said floating plane;

linking and sliding orthogonal means for coupling said floating plane to said base such that the intermediate partition is arranged between said floating plane and said base; and on a plane of the base arranged adjacent said intermediate partition, at each linking and sliding orthogonal means, a portion of said wall of said intermediate partition with undercut sloping walls, said portion of said wall being lodged in a corresponding seat provided in said base.

12. Floating plane according to claim 11, wherein the intermediate partition is delimited: on a base side thereof by a stiff metal wall; along a perimeter thereof by peripheral walls of said elastic wall that fit a peripheral edge of said base; and on a punch side thereof by said elastic wall which couples to a whole bottom of the floating plane.

13. Floating plane according to claim 12, wherein the elastic wall, coupled to the bottom of the floating plane, include peripherally extending extensions coupling to an external surface of the peripheral edge of said base.

14. Floating plane according to claim 13, wherein the peripheral edge of the base is slidingly centered with respect to an external peripheral edge of said floating plane.

15. Floating plane according to claim 11, wherein said linking and sliding orthogonal means include a longitudinal axis of symmetry extending in a direction along which said linking and sliding orthogonal means are adapted to slide.

16. Floating plane according to claim 15, wherein the linking and sliding orthogonal means are constituted by:

sleeves with step-like stops which are provided on the base;

pistons adapted for sliding in said sleeves and being biased for engagement with said stops; and screws for coupling said pistons to said floating plane.

17. Floating plane according to claim 11, further comprising elastic peripheral elements of said intermediate partition to which said linking and sliding orthogonal means are coupled so as to provide a fluid-tight seal inside said intermediate partition for the operating fluid.

18. Floating plane according to claim 13, wherein said elastic wall and said peripheral walls and said extensions and said portion with undercut sloping walls all form a monolithic element void of discontinuities and separations, said elastic material being an elastically deformable and pressure-resistant material.

19. Floating plane according to claim 11, wherein the floating plane and the base have mutually facing surfaces of substantially equal dimensions.

20. Floating plane according to claim 19, wherein the floating plane comprises a peripheral edge which is telescopically coupled with a peripheral edge of the base.

* * * * *